US010633817B2

(12) United States Patent
Kuppalli

(10) Patent No.: US 10,633,817 B2
(45) **Date of Patent: *Apr. 28, 2020**

(54) REMOVING SUBMERGED PILES OF OFFSHORE PRODUCTION PLATFORMS

(71) Applicant: Saudi Arabian Oil Company, Dhahran (SA)

(72) Inventor: Prakasha Subramanyam Kuppalli, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/448,984

(22) Filed: Jun. 21, 2019

(65) Prior Publication Data

US 2019/0352877 A1 Nov. 21, 2019

Related U.S. Application Data

(63) Continuation of application No. 15/980,260, filed on May 15, 2018, now Pat. No. 10,392,769.

(51) Int. Cl.
*E02D 9/00* (2006.01)
*E02D 7/06* (2006.01)
(Continued)

(52) U.S. Cl.
CPC ..... *E02D 9/005* (2013.01); *E02D 7/06* (2013.01); *E02D 7/28* (2013.01); *E02D 9/00* (2013.01);
(Continued)

(58) Field of Classification Search
CPC ... E02B 2017/0052; E02D 9/005; E02D 7/06; E02D 13/00
See application file for complete search history.

(56) References Cited

U.S. PATENT DOCUMENTS 4,408,668 A 10/1983 Kuhn
4,808,037 A 2/1989 Wade
(Continued)

FOREIGN PATENT DOCUMENTS

| | | |
|---|---|---|
| EP | 2312060 | 4/2011 |
| GB | 2089407 | 6/1982 |
| WO | 8803195 | 5/1988 |

OTHER PUBLICATIONS

Mokhtar, "Decomissioning of Offshore Platforms," ADMA-OPCO, Jun. 10, 2014, 45 pages.
(Continued)

*Primary Examiner* — Benjamin F Fiorello
(74) *Attorney, Agent, or Firm* — Fish & Richardson P.C.

(57) ABSTRACT

Certain aspects of removing submerged piles of offshore production platforms can be implemented as methods. A top deck of a fixed offshore platform installed on a mudline of a body of water is removed. An upper structure of the fixed offshore platform is removed. The upper structure is below the top deck. A lower structure is secured to the mudline by one or more structural piles remaining. The one or more structural piles, which are housed within one or more members of the lower structure, are driven below the mudline. The lower structure of the fixe offshore platform is removed. The one or more structural piles are left below the mudline.

5 Claims, 6 Drawing Sheets

(51) Int. Cl.

| | |
|---|---|
| ***E02D 13/00*** | (2006.01) |
| ***E02D 7/28*** | (2006.01) |
| *E02B 17/00* | (2006.01) |

(52) U.S. Cl.
CPC ..... *E02D 13/00* (2013.01); *E02B 2017/0052* (2013.01)

(56) References Cited

U.S. PATENT DOCUMENTS

| | | | | |
|---|---|---|---|---|
| 5,002,432 | A | 3/1991 | Dysarz | |
| 5,028,171 | A | 7/1991 | Gray | |
| 5,525,010 | A | 6/1996 | Kenny | |
| 5,593,250 | A | 1/1997 | Smith et al. | |
| 6,131,517 | A | 10/2000 | Poe | |
| 6,183,165 | B1 | 2/2001 | Heinrichs | |
| 8,056,633 | B2 | 11/2011 | Barra | |
| 8,500,369 | B2 | 8/2013 | Mohr | |
| 8,820,472 | B2 | 9/2014 | Jung | |
| 9,222,328 | B2 | 12/2015 | Stokes | |
| 10,392,769 | B1 * | 8/2019 | Kuppalli | E02D 7/06 |
| 2014/0231085 | A1 | 8/2014 | Zediker | |

OTHER PUBLICATIONS

Thomas, "Technical Report: Guided wave test of 36" Pile Pipe in Saudi Aramco SFNY-26 Platform," ISS, Industrial Support Services Company, May 12, 2017, 16 pages.

International Search Report and Written Opinion issued in International Application No. PCT/US2019/031416 dated Oct. 23, 2019, 19 pages.

International Invitation to Pay Additional Fees and, Where Applicable, Protest Fee issued in International Application No. PCT/US2019/031416 dated Aug. 20, 2019, 13 pages.

* cited by examiner

REMOVING SUBMERGED PILES OF OFFSHORE PRODUCTION PLATFORMS

CROSS REFERENCE TO RELATED APPLICATIONS

This application is a Continuation of U.S. patent application Ser. No. 15/980,260, filed on May 15, 2018, the entire contents of which is incorporated herein by reference.

TECHNICAL FIELD

This disclosure relates to offshore fixed platforms, for example, the installation or removal of such platforms.

BACKGROUND

Offshore platforms may need to be dismantled either for decommissioning after their useful lives or for installing new platforms at the same locations to accommodate more equipment or wells (both). Installing and commissioning an offshore platform can involve placing a large structure on a mudline, or seabed, within a body of water. In the case of a jacketed platform, a steel frame structure is secured to the mudline with piles. A portion of the structure surrounds, or "jackets" the piles. Dismantling involves removing the platform sufficiently so that it does not create a navigation hazard, cause any harm to the environment or facilitate installation of a slip-over platform. In the case of fixed offshore platforms, such removal often involves a near complete removal of the fixed platform since fixed platforms are often installed in shallow bodies of water. Removal of fixed platforms down to a mudline of a body of water is common.

In the case of a jacketed platform, removal often involves cutting a structural pile from within the pile a few feet below the mudline. This operation can involve cutting the pile from the pile's interior, lowering explosive charges into the piles, or other methods of cutting from the interior of the pile such as water jetting. The latter can disturb the seabed or degrade the seabed soil (or both).

SUMMARY

This disclosure describes technologies relating to removing submerged piles.

Certain aspects of the subject matter described here can be implemented as a method. A top deck of a fixed offshore platform installed on a mudline of a body of water is removed. An upper structure of the fixed offshore platform is removed. The upper structure is below the top deck. A lower structure is secured to the mudline by one or more structural piles remaining. The one or more structural piles, which are housed within one or more members of the lower structure, are driven below the mudline. The lower structure of the fixe offshore platform is removed. The one or more structural piles are left below the mudline.

Other aspects, taken alone or in combination with any of the other aspects, can include the following features. To remove the upper structure of the fixed offshore platform, shim plates, which are configured to attach the one or more structural piles within the one or more members of the lower structure, can be cut.

Other aspects, taken alone or in combination with any of the other aspects, can include the following features. To drive the one or more structural piles below the muddling, a chaser pile can be positioned to have a first end abut and be in-line with one of the one or more structural piles. The chaser pile can have a diameter sufficient to abut the structural pile. A hammer driver can be positioned at a second end of the chaser pile opposite the first end. The chaser pile can be hammered with the hammer driver to drive the structural pile below the mudline.

Other aspects, taken alone or in combination with any of the other aspects, can include the following features. The chaser pile can include an insert at the first end to insert into the structural pile. The insert can centralize the chaser pile to be in-line with the structural pile.

Other aspects, taken alone or in combination with any of the other aspects, can include the following features. The chaser pile can be retrieved prior to removing the lower structure of the fixed offshore platform.

Other aspects, taken alone or in combination with any of the other aspects, can include the following features. The chaser pile can include an outer surface defining a central opening. To retrieve the chaser pile, an internal lifting tool can be inserted into the central opening.

Other aspects, taken alone or in combination with any of the other aspects, can include the following features. The internal lifting tool can be a hydraulically actuated tool.

Certain aspects of the subject matter described here can be implemented as a method of clearing piles from a body of water. A chaser pile is positioned to have a first end of the chaser pile to be abut and in-line with an end of a structural pile. The chaser pile has a diameter sufficient to abut the structural pile. A hammer driver is positioned at a second end of the chaser pile opposite the first end. The chaser pile is hammered with the hammer driver to drive the structural pile below a mudline of a body of water.

Other aspects, taken alone or in combination with any of the other aspects, can include the following features. The chaser pile includes an insert at the first end configured to insert into the structural pile. The insert can centralize the chaser pile to be in-line with the structural pile.

Other aspects, taken alone or in combination with any of the other aspects, can include the following features. The chaser pile can include an outer surface defining a central opening. To retrieve the chaser pile, an internal lifting tool is inserted into the central opening.

Other aspects, taken alone or in combination with any of the other aspects, can include the following features. The internal lifting tool can be a hydraulically actuated tool.

Other aspects, taken alone or in combination with any of the other aspects, can include the following features. The structural pile can secure a fixed offshore platform. A top deck of the fixed offshore platform, which is installed on the mudline of a body of water, can be removed. An upper structure of the fixed offshore platform, which is below the top deck, can be removed. A lower structure can be secured to the mudline by one or more structural piles remaining. The lower structure of the fixed offshore platform can be removed after the structural pile has been hammered below the mudline. To remove the upper structure of the fixed offshore platform, shim plates, which can attach the structural pile within a member of the lower structure, can be cut. The chaser pile can be removed prior to removing the lower structure of the fixed offshore platform. The chaser pile can include an outer surface defining a central opening. To retrieve the chaser pile, an internal lifting tool can be inserted into the central opening. The internal lifting tool can be a hydraulically actuated tool.

Certain aspects of the subject matter described here can be implemented as a method. A top deck of a fixed offshore platform installed on a mudline of a body of water is removed. An upper structure of the fixed offshore platform is removed. The upper structure is below the top deck. A lower structure is secured to the mudline by one or more structural piles remaining. A chaser pile is positioned to have a first end of the chaser pile be abut and in-line with an end of a structural pile. The chaser pile has a diameter sufficient to abut the structural pile. A hammer driver is positioned at a second end of the chaser pile opposite the first end. The chaser pile is hammered with the hammer driver to drive the structural pile, housed within one or more members of the lower structure, below the mudline of the body of water. The lower structure of the fixed offshore platform is removed. The one or more structural piles are left below the mudline.

Other aspects, taken alone or in combination with any of the other aspects, can include the following features. The chaser pile includes an insert at the first end that can insert into the structural pile. The insert can centralize the chaser pile to be in-line with the structural pile.

Other aspects, taken alone or in combination with any of the other aspects, can include the following features. The chaser pile can include an outer surface defining a central opening. To retrieve the chaser pile, an internal lifting tool is inserted into the central opening.

Other aspects, taken alone or in combination with any of the other aspects, can include the following features. To remove the upper structure of the fixed offshore platform, shim plates configured to attach the one or more structural piles within the one or more members of the lower structure are cut.

Other aspects, taken alone or in combination with any of the other aspects, can include the following features. The chaser pile can be retrieved prior to removing the lower structure of the fixed offshore platform.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Dismantling jacketed platforms requires the removal of the structural piles that secure the jacket to a mudline of a body of water. Traditional removal methods can include the use of dangerous materials, such as explosives, and working under dangerous conditions for workers, such as diving and cutting in a confined space. These dangerous tasks are often necessary to completely remove a fixed platform structure so that no structure extends above the mudline. Other dismantling methods can include water jetting that can disturb the seabed or degrade the seabed soil (or both). Many jurisdictions require such removal to ensure that there are no navigation hazards in the body of water that the platform inhabited.

This disclosure relates to a method for dismantling a fixed offshore platform. The method includes removing the top deck and upper structure with conventional methods, hammering down the existing piles with a chaser pile and a driver until the original pile is below the mudline, removing the driver and chaser pile, then removing the remaining jacket. The original piles remain buried in the seabed.

Figure 1A:
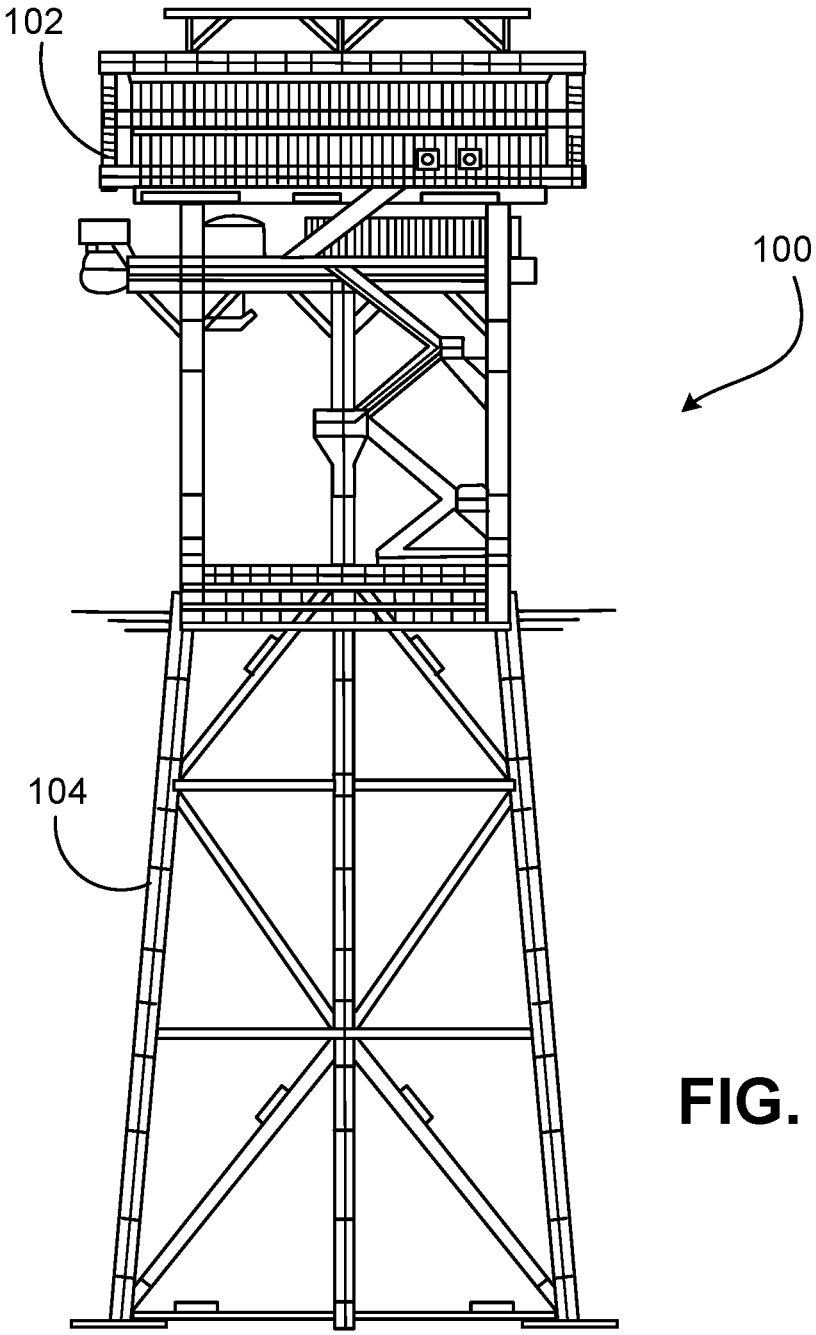
FIG. 1A is a perspective schematic diagram of an example fixed offshore platform.

FIG. 1A shows a perspective view of a schematic diagram of an example fixed offshore platform 100. The fixed platform includes a top deck 102 that sits atop a main platform structure 104. The main platform structure 104 rests above a mudline within a body of water. The body of water can include a lake, river, ocean, or any other body of water. The fixed platform can include a steel structure configured to support the top deck 102. The top deck 102 can include processing equipment for oil and gas production, pipeline infrastructure, power generating facilities, recreation facilities, or any combination.

Figure 1B:
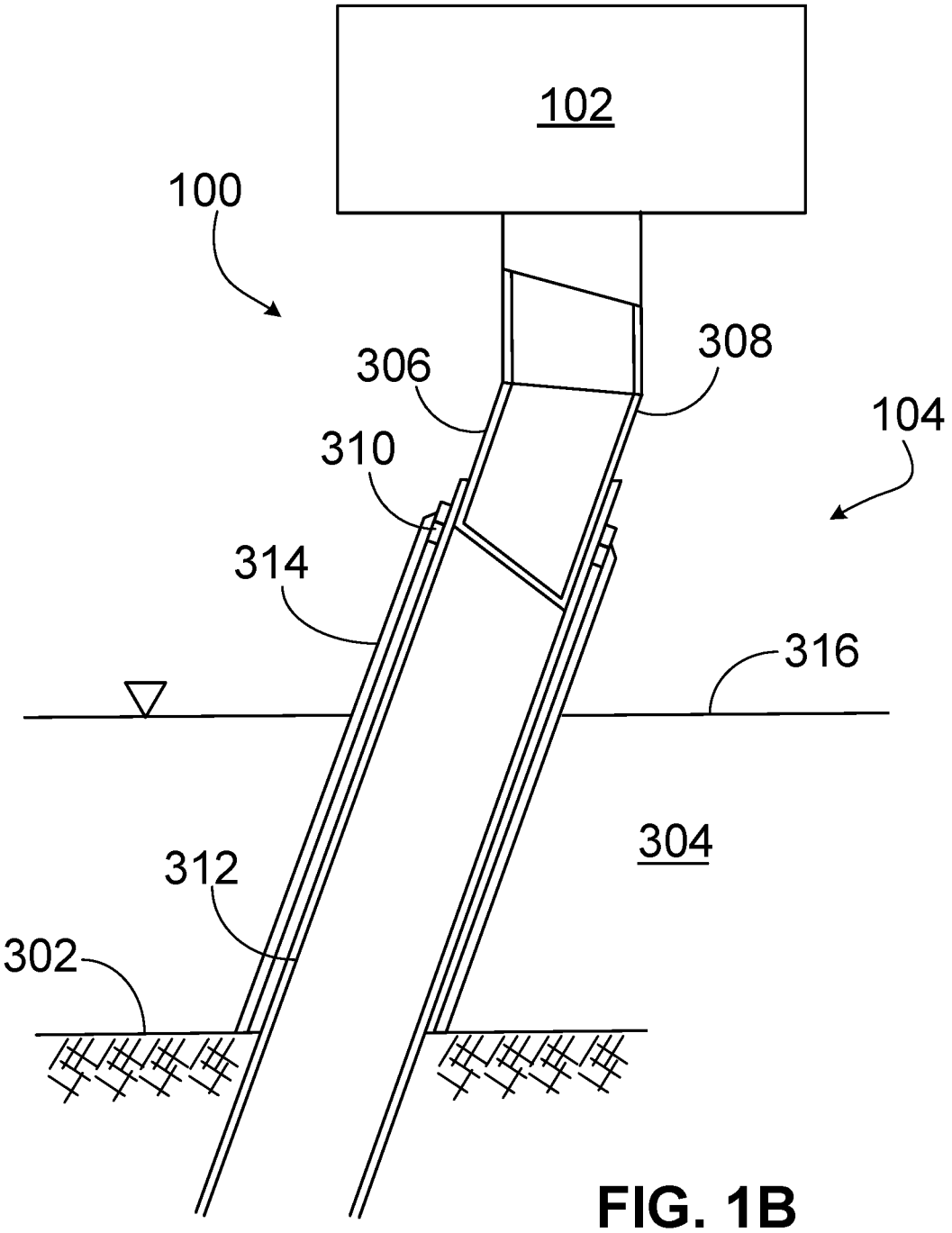
FIG. 1B is a side cross-sectional view of an example jacketed leg of the example fixed offshore platform.

FIG. 1B is a side cross-sectional view of an example jacketed leg of the example platform 100. The fixed offshore platform 100 is installed on a mudline 302 of a body of water 304. At 202, the top deck 102 of the platform 100 is removed. Removing the top deck 102 can include heavy lifts, cutting, or any other removal steps. For example, an operator or team of operators can remove the top deck 102 with an offshore barge with suitable cranes. At 204, a structure 306 of the fixed offshore platform 100 is removed. The transition piece 308 that is configured to redirect a load from one direction to another. For example, as illustrated, the transition piece 308 redirects the load from a vertical load to an angled load. In some implementations, the transition piece 308 includes a hollow steel tube with a bend towards the middle of the tube. In some instances, the transition piece 308 rests on a structural pile 312. Removing the transition piece 308 can include heavy lifts, cutting, un-bolting, or any other removal steps. In some implementations, the upper structure 306 and transitional piece 308 are connected and can be considered an effective single structure. In some implementations, before driving the structural pile 312, it is detached from jacket or lower structure 314 by cutting the shim plates 310. The lower structure 314 is secured to the mudline 302 by one or more structural piles 312. The piles 312 are held in place by the pressure and friction of the soil that surrounds the piles below the mudline 302. The lower structure 314 is secured to the piles by shim plates 310. The structural pile 312 itself can include a long, hollow steel tube that is open at one or both ends. The lower structure 314 remains in place after the top deck 102, the transition piece 308 and shim plates 310 are removed. While the illustrated implementation shows a waterline 316 being below the transition piece 308, upper structure 306, and shim plates 310, the waterline 316 can land anywhere between the mudline 302 and the shim plate 310 without departing from this disclosure.

Figure 2:
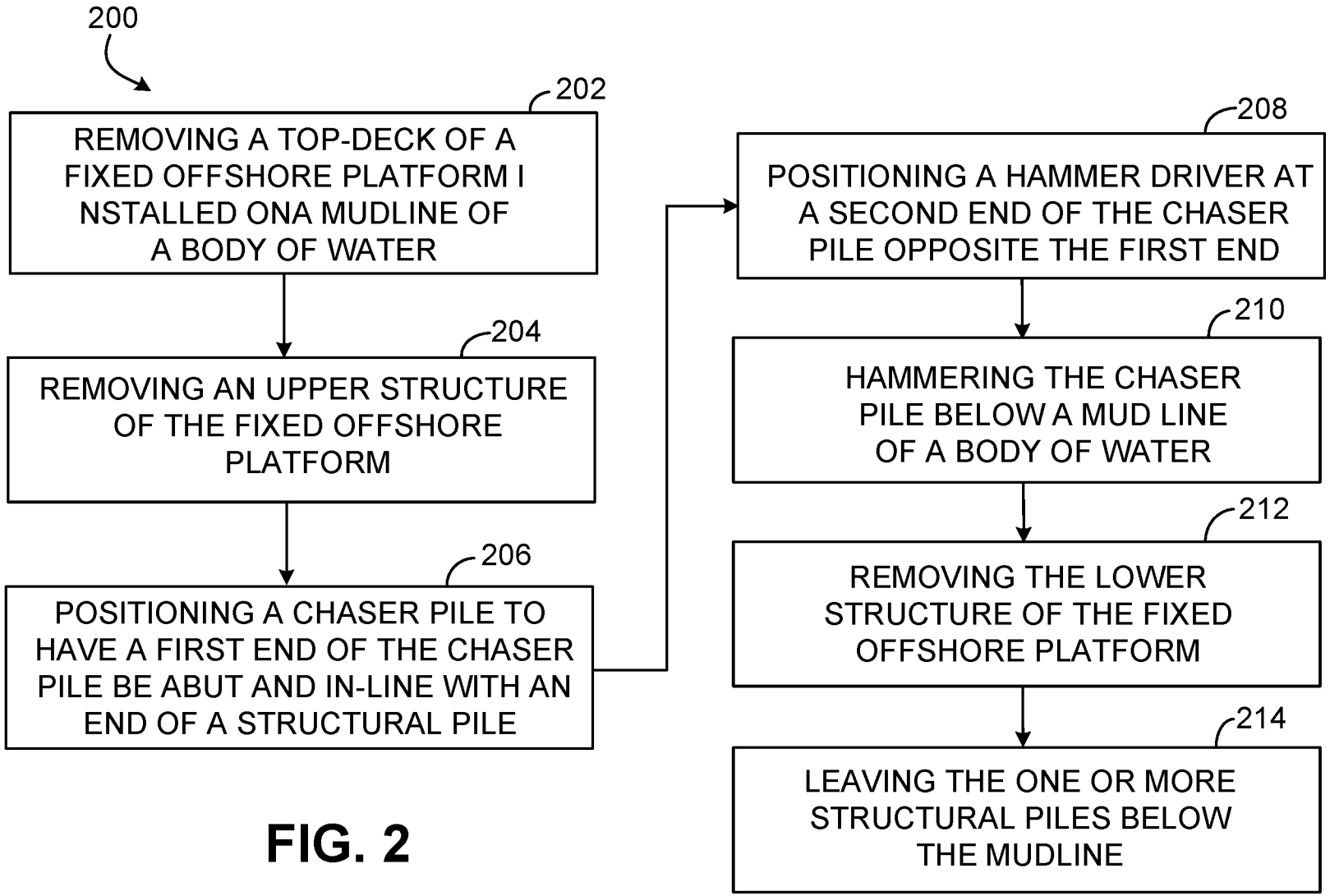
FIG. 2 is a flowchart of an example method that can be used with aspects of this disclosure.

FIG. 2 is a flowchart of an example method 200 that can be used with aspects of this disclosure. Steps of this method will be referenced throughout the remainder of this disclosure.

Figure 3:
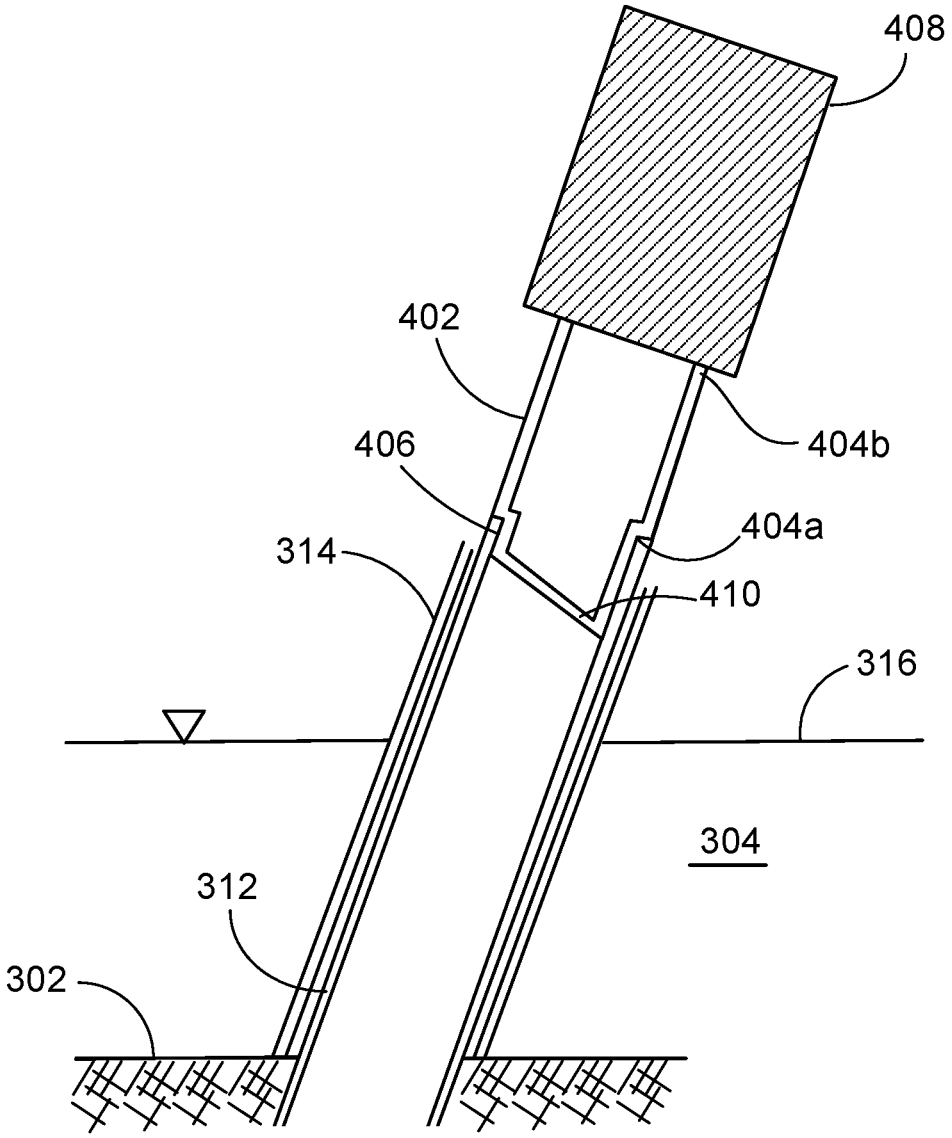
FIG. 3 is a side cross-sectional view of an example pile being driven below a mudline of a body of water.

FIG. 3 is a side cross-sectional view of the example structural pile 312 being driven below the mudline 302 of the body of water 304. Referring back to FIG. 2, at 206, a chaser pile 402 is positioned to have a first end 404*a* of the chaser pile 402 to be abut and in-line with an end 406 of the structural pile 312. The chaser pile 402 has a diameter sufficient to abut the structural pile 312. In some implementations, the chaser pile 402 can include an insert 410 at the first end 404*a* of the chaser pile 402. For example, the insert can be a stabbing guide or a rolled bar. The insert 410 is configured to insert into the structural pile 312 and centralize the chaser pile 402 to be in-line with the structural pile 312. That is, a central longitudinal axis of the central chaser pile 402 is aligned with a central longitudinal axis of the structural pile 312. At 208, a hammer driver 408 is positioned at a second end 404*b* of the chaser pile 402 opposite the first end. At 210, the chaser pile 402 is hammered with the hammer driver 408 to drive the structural pile 312 below the mudline 302 of the body of water 304. In some implementations, the hammer driver 408 includes an anvil and a ram (not shown). For example, the structural pile 312 can be driven so that the end 406 of the structural pile 312 is a few feet below the mudline 302, so long as the structural pile 312 is sufficiently below the mudline to prevent any navigational hazard or obstruction to installing the new slip-over platform. In some implementations, the structural piles may not be fully driven below the mudline 302, so long as they are driven to a sufficient depth to prevent navigational hazards. In some instances, prior to hammering the structural pile 312, a pile drivability analysis is performed to ensure that the structural pile 312 can be hammered below the mudline 302. In some instances, drivability may not be possible, such as if the hammer doesn't has have enough energy, or the pile stresses during driving increase beyond yield strength of steel. The former can be addressed by using higher energy hammers, but since the piles are existing, stresses are limited the below yield strength of the steel. This in turn will not allow the use higher energy hammer beyond a certain limit. The drivability analysis provides both the hammer energy required as well as the stresses in the pile. The structural pile 312 is housed within the member of the lower structure 314 during hammering operations. After the structural pile 312 is driven below the mudline 302, the chaser pile 402 is retrieved. That is, the chaser pile 402 is retrieved prior to removing the lower structure 314.

Figure 4:
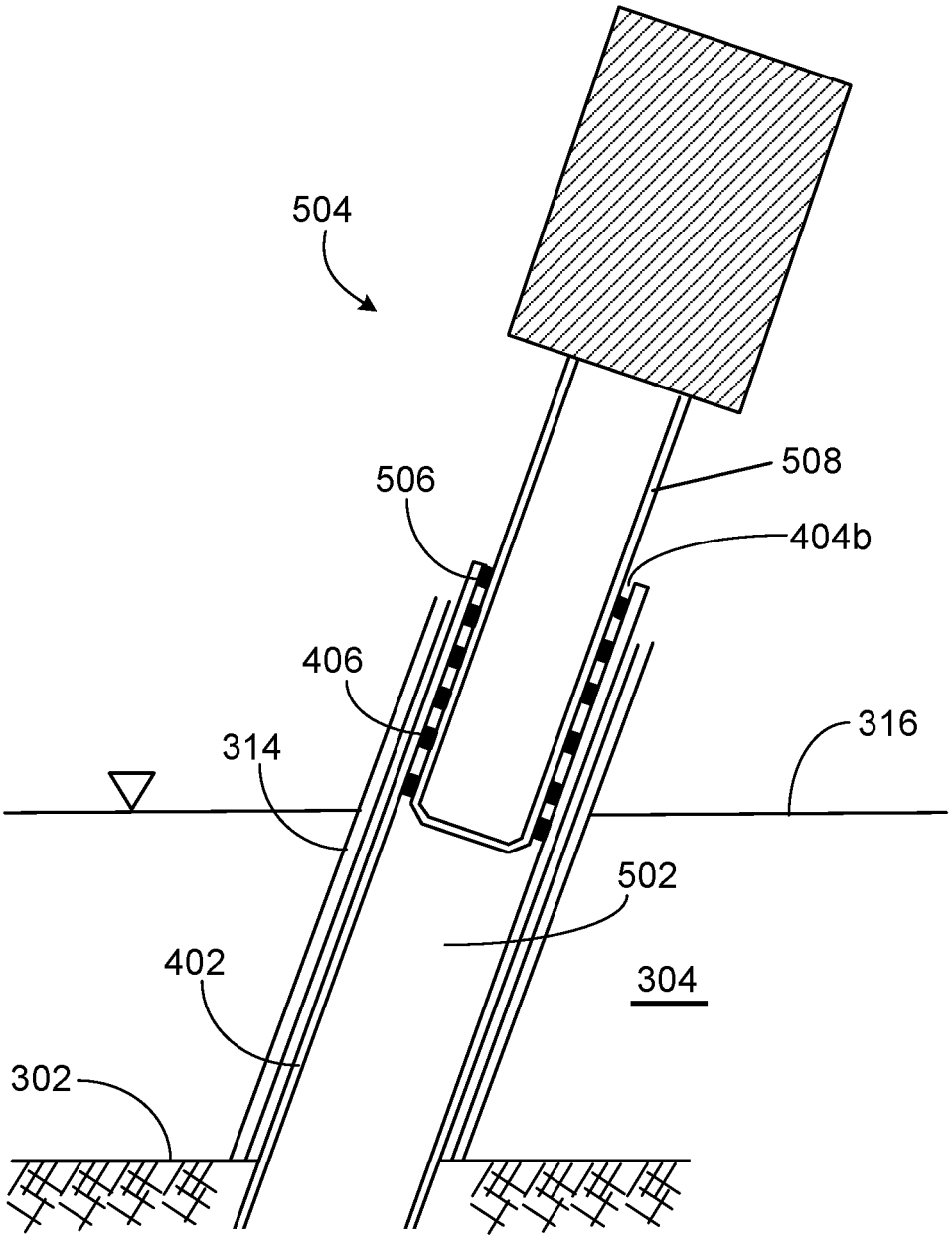
FIG. 4 is a side cross-sectional view of an example chaser pile being retrieved from a jacket.

FIG. 4 is a side cross-sectional view of an example chaser pile 402 being retrieved from lower structure 314. The chaser pile 402 includes an outer surface that defines a central opening 502. Retrieving the chaser pile 402 includes inserting an internal lifting tool 504 into the central opening 502. In some implementations, the internal lifting tool 504 is a hydraulically actuated tool. In such an implementation, the tool extends gripping members 506 from a central core 508 of the tool 504 to grip an inner surface of the chaser pile 402. Once the internal lifting tool 504 has a hold of the chaser pile 402, the tool 504 and the chaser pile 402 are retrieved by a crane, winch, or other retraction mechanism. In some instances, the internal lifting tool 504 is used to help position the chaser pile 402 prior to driving operations.

Figure 5:
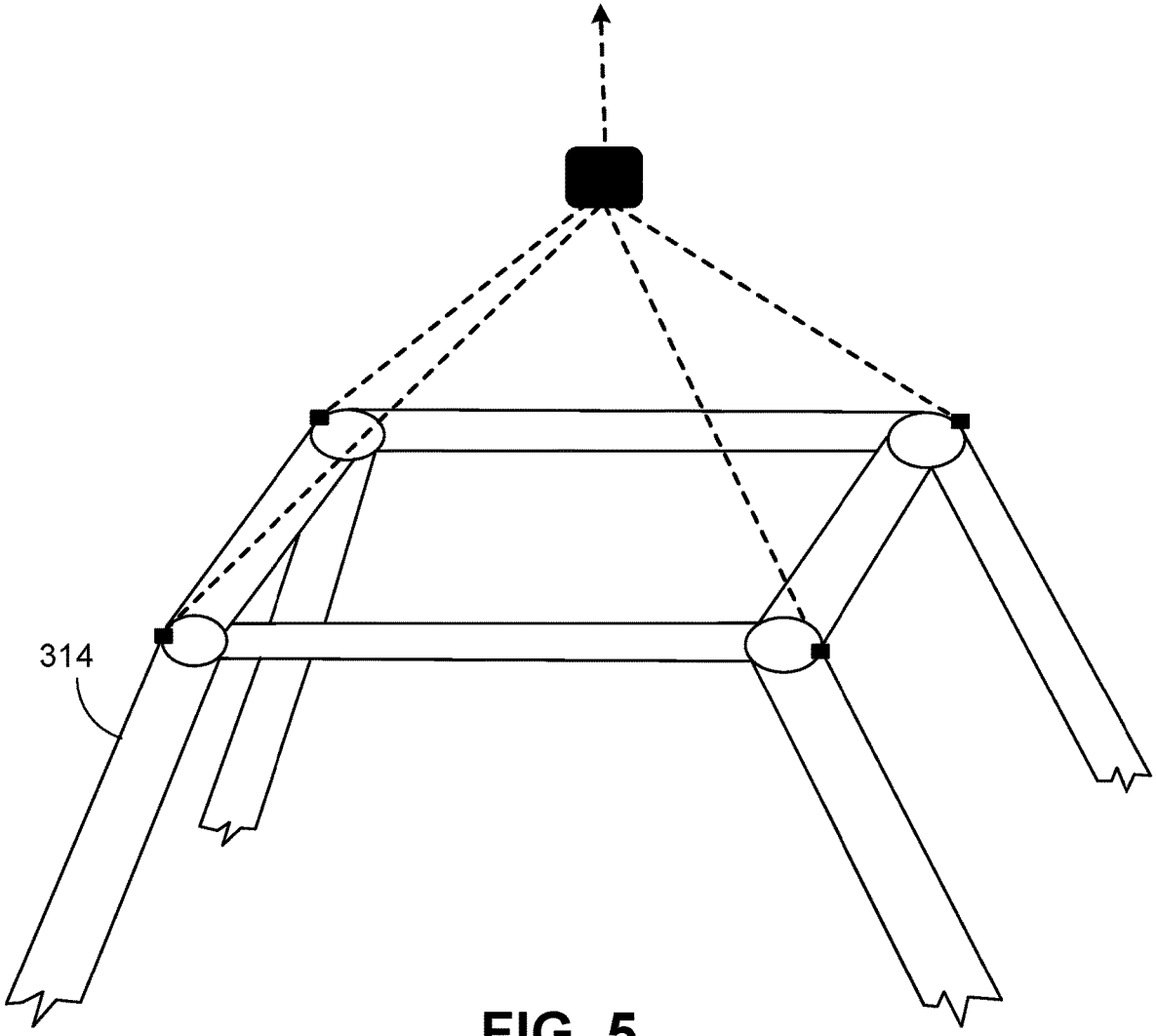
FIG. 5 is a perspective schematic diagram of an example fixed offshore platform being lifted.

FIG. 5 is a perspective schematic diagram of an example lower structure 314 of the fixed offshore platform 100 being lifted. Referring back to FIG. 2, at 212, the lower structure 314 of the fixed offshore platform 100 is removed. The lower structure 314 is removed, for example, by an offshore crane sufficient of rated capacity to lift the lower structure 314. After the lower structure 314 is removed, at 214, any structural piles 312 that once secured the platform 100 are left below the mudline. As the structural piles 312 are below the mudline 302, the structural piles 312 no longer pose a navigation risk to passing vessels or obstruction to the installation of the new slip-over platform.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may have been previously described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations previously described should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method of clearing piles from a body of water, the method comprising:

positioning a chaser pile to have a first end of the chaser pile be abut and in-line with an end of a structural pile, the chaser pile comprising a diameter sufficient to abut the structural pile, the chaser pile comprising an outer surface defining a central opening;

positioning a hammer driver at a second end of the chaser pile opposite the first end;

hammering the chaser pile with the hammer driver to drive the structural pile below a mudline of a body of water; and retrieving the chaser pile, wherein retrieving the chaser pile comprises inserting a hydraulically actuated internal lifting tool into the central opening.

2. The method of claim 1, wherein the chaser pile comprises an insert at the first end configured to insert into the structural pile, the insert configured to centralize the chaser pile to be in-line with the structural pile.

3. The method of claim 1, wherein the structural pile is configured to secure a fixed offshore platform, the method further comprising:

removing a top deck of the fixed offshore platform installed on the mudline of a body of water;

removing an upper structure of the fixed offshore platform, the upper structure being below the top deck, a lower structure secured to the mudline by one or more structural piles remaining; and removing the lower structure of the fixed offshore platform after the structural pile has been hammered below the mudline.

4. The method of claim 3, wherein removing the upper structure of the fixed offshore platform comprises cutting shim plates configured to attach the structural pile within a member of the lower structure.

5. The method of claim 3, wherein the chaser pile is retrieved prior to removing the lower structure of the fixed offshore platform.

* * * * *